US008424121B2

(12) United States Patent
Quick

(10) Patent No.: US 8,424,121 B2
(45) Date of Patent: Apr. 23, 2013

(54) ODOUR EXTRACTION DEVICE FOR A TOILET PAN

(76) Inventor: Geoffrey Charles Quick, Balgowlah (AU)

( * ) Notice: Subject to any disclaimer, the term of this patent is extended or adjusted under 35 U.S.C. 154(b) by 1060 days.

(21) Appl. No.: 12/087,633

(22) PCT Filed: Jan. 5, 2007

(86) PCT No.: PCT/AU2007/000003
§ 371 (c)(1),
(2), (4) Date: Nov. 12, 2008

(87) PCT Pub. No.: WO2007/079524
PCT Pub. Date: Jul. 19, 2007

(65) Prior Publication Data

US 2009/0089920 A1 Apr. 9, 2009

(30) Foreign Application Priority Data

Jan. 10, 2006 (AU) ..... 2006900108
Feb. 28, 2006 (AU) ..... 2006901004

(51) Int. Cl.
*E03D 9/04* (2006.01)

(52) U.S. Cl.
USPC ..... 4/216; 4/347; 4/209 R

(58) Field of Classification Search ..... 52/213, 52/216–217, 347, 348, 349, 350, 351; 4/213, 4/216–217, 347, 348, 349, 350, 351, 209 R, 4/219
See application file for complete search history.

(56) References Cited

U.S. PATENT DOCUMENTS

| | | | | |
|---|---|---|---|---|
| 2,008,030 | A * | 7/1935 | Merrick | 222/37 |
| 4,103,370 | A * | 8/1978 | Arnold | 4/213 |
| 5,179,738 | A * | 1/1993 | Sowards | 4/213 |
| 5,263,510 | A * | 11/1993 | Heimann et al. | 137/359 |
| 5,813,060 | A * | 9/1998 | Klopocinski | 4/351 |
| 5,980,739 | A * | 11/1999 | Jowett et al. | 210/151 |
| 6,496,988 | B1 * | 12/2002 | Hammond | 4/317 |
| 6,526,598 | B1 * | 3/2003 | Black | 4/214 |
| 6,938,491 | B2 * | 9/2005 | Clark et al. | 73/753 |
| 6,983,491 | B2 * | 1/2006 | Curtis et al. | 4/216 |
| 7,685,683 | B2 * | 3/2010 | Coles et al. | 24/16 PB |

FOREIGN PATENT DOCUMENTS

| | | |
|---|---|---|
| DE | 100 33 930 A1 | 10/2001 |
| GB | 2 184 140 A | 6/1987 |
| GB | 2 379 462 A | 3/2003 |
| GB | 2 384 009 A | 7/2003 |
| WO | WO 03/064778 A1 | 8/2003 |

* cited by examiner

*Primary Examiner* — Jeanette E. Chapman
(74) *Attorney, Agent, or Firm* — Kilpatrick Townsend & Stockton LLP

(57) ABSTRACT

An odor extraction device (1) for a toilet having a pan (2) and a cistern (4) is disclosed. The extraction device (1) includes an inlet (3) and an outlet (5). The inlet (3) is adapted for gas communication with an interior of the toilet pan (2) above the water level in the pan (2). The outlet (5) is in gas communication with the inlet (3). The outlet (5) is also adapted for gas communication with a sewerage pipe (6). A suction means, in the form of an impeller fan (7), is provided intermediate the inlet (3) and the outlet (5) for drawing gas from within the pan (2) in through the inlet (3) and out through the outlet (5). To prevent backflow of unpleasant odors from the sewerage pipe (6) to the pan (2), a one way valve (8) is provided between the inlet (3) and the outlet (5).

35 Claims, 6 Drawing Sheets

ODOUR EXTRACTION DEVICE FOR A TOILET PAN

CROSS-REFERENCE TO RELATED APPLICATIONS

This application is a National Stage of International Application No. PCT/AU2007/000003, filed Jan. 5, 2007, and which claims the benefit of Australian Patent Applications Nos. 2006900108, filed Jan. 10, 2006, and 2006901004, filed Feb. 28, 2006, the disclosures of which applications being incorporated herein by reference.

FIELD OF THE INVENTION

The present invention relates to an odour extraction device for a toilet pan and, in particular, to an odour extraction device including a one way valve for preventing backflow of foul odours.

The device has been primarily developed for use in toilets in fixed homes and will be described hereinafter with reference to this application. However, the invention is not limited to this particular use and is also applicable for use with toilets in other environments such as: marine vessels; mobile homes; campervans; recreational vehicles; caravans; portable buildings; and portable toilets.

BACKGROUND OF THE INVENTION

It is known to exhaust gases from rooms containing toilets by way of ceiling or wall mounted exhaust fans. However, a disadvantage of exhaust systems of this type is that unpleasant odours must be drawn from the toilet pan and through the room in order to reach the exhaust fan. Accordingly, subsequent users of the toilet often still encounter unpleasant odours. This situation is exacerbated when the toilet is located in a confined space and/or located adjacent habitable or food preparation areas.

Ventilation devices that withdraw gases directly from domestic toilet pans are also known. Such devices generally include an inlet in gas communication with the interior of the toilet pan that is connected to a suction device. The suction device is in turn connected to an outlet positioned remotely from the room that contains the toilet. Removing odours directly from the toilet pan substantially lowers the chance of a subsequent user of the toilet, or anyone near the room containing the toilet, from encountering unpleasant odours.

The extracted unpleasant odours are commonly exhausted to the exterior of the building that houses the toilet via ducting. The ducting is usually installed inside a wall (either chased into masonry or positioned within stud wall partitions) for concealment. However, this makes such installations difficult, particularly running the ducting to a suitable exterior discharge point, and expensive and only suitable for use in bathrooms that are either under construction or refurbishment. It is also often difficult to obtain an adequate power supply given many known systems use a fan driven by a 240 Volt AC motor.

To alleviate some of these problems, it is also known to direct the unpleasant odours directly into the sewer, at a location downstream of the toilet water seal (ie. water trap). However, to meet the plumbing codes and regulations in many jurisdictions, such a system must include an approved one-way valve between the suction device and the outlet sewer.

OBJECT OF THE INVENTION

It is an object of the present invention to provide a simple, inexpensive, odour extraction device with a fail safe, one-way valve to prevent unpleasant odours from flowing from the sewer back to the toilet pan, especially in the event of a loss of power.

SUMMARY OF THE INVENTION

Accordingly, in a first aspect, the invention provides an odour extraction device for a toilet pan, the odour extraction device comprising:

- an inlet adapted for gas communication with an interior of the toilet pan above a water level in the pan;
- an outlet in gas communication with the inlet and adapted for gas communication with a sewerage pipe; and
- a suction means for drawing gas from within the pan in through the inlet and out through the outlet;
- a one way valve between the inlet and the outlet, the valve comprising a valve member and a valve seat, the valve member being biased, by gravity, toward a closed position blocking gas communication between the inlet and the outlet by sealing engagement of the valve member with the valve seat,
- wherein the pressure differential generated across the valve member by the suction means disengages the valve member from the valve seat to allow the gas to flow therethrough.

As the valve member is gravitationally biased towards a closed position, it is adapted to automatically move due to its own weight into sealing engagement with the valve seat in the absence of the fluid pressure generated by the suction means (e.g. if power supply to the suction means is removed or fails).

The suction means preferably includes an impeller fan. More preferably, gases from the inlet are drawn through the rotational centre of the impeller fan.

In one form, a substantially airtight housing is preferably provided intermediate the inlet and the outlet, the housing containing the suction means and the valve member. More preferably, the housing comprises a cylinder within which the valve member is axially slidably movable. In a preferred form, the outlet extends from a side of said cylinder. The valve member is preferably a circular disc. A plenum extends preferably between the suction means and the valve seat.

In another embodiment, a substantially airtight housing is preferably provided intermediate the inlet and the outlet, the housing containing the suction means and the valve member. Preferably, the housing includes a guide post along which the valve member is axially slidable between an open position and the closed position. More preferably, a divider extends across the housing to divide a section of the housing upstream of the one way valve from a section of the housing downstream of the one way valve. In a preferred form, the valve seat is defined by the rim of a circular opening in the divider. Preferably also, the guide post axially extends through a centre of the circular opening. The valve member is preferably bowl shaped and has a convex sealing surface engageable with the valve seat. More preferably, the valve member includes a generally cylindrical guide sleeve slidably engageable around the guide post for guiding the valve member during movement between the open and closed positions. Preferably, the housing includes a sub-casing for containing the impeller fan. More preferably, a plenum extends between the sub-casing and the one way valve.

Preferably, the housing is adapted for installation in a toilet cistern. More preferably, the inlet is defined by an opening in the housing, through which the impeller fan draws gas from within the cistern. The action of the impeller fan preferably creates a negative pressure within the cistern to draw gas from the toilet pan through an overflow pipe of the toilet, into the cistern, through the opening in the housing, through the housing and out through the outlet for discharge into the sewerage pipe.

The suction means is preferably actuated by an electric motor, more preferably, a 12V DC electric motor.

An inlet conduit preferably extends from the inlet for fluidly connecting the inlet to the toilet pan. More preferably, an outlet conduit extends from the outlet for fluidly connecting the outlet to the sewerage pipe. In preferred forms, the inlet and/or outlet conduits are flexible.

Preferably, the suction means is adapted to generate a gas flow rate of greater than around 2 L/s, more preferably greater than around 3 L/s, and in a particularly preferred form above about 3.3 L/s.

Accordingly, in a second aspect, the invention provides a one way valve for a toilet odour extraction device, the valve comprising:

an inlet;

an outlet;

a valve seat; and a valve member biased, by gravity, towards a closed position blocking gas communication between the inlet and the outlet by sealing engagement of the valve member with the valve seat, wherein the valve member is adapted to disengage from the valve seat to allow gas to flow through the valve in response to the generation of a pressure differential across the valve member.

BRIEF DESCRIPTION OF THE DRAWINGS

A preferred embodiment of the present invention will now be described, by way of an example only, with reference to the accompanying drawings wherein.

DETAILED DESCRIPTION OF THE PREFERRED EMBODIMENT

Figure 1:
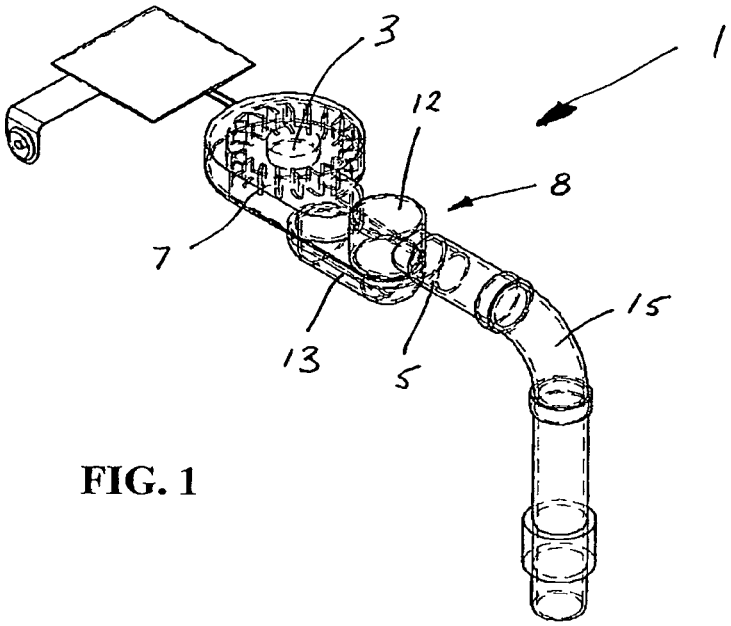
FIG. 1 is a perspective view of a first preferred embodiment of an odour extraction device according to the invention.
Figure 2:
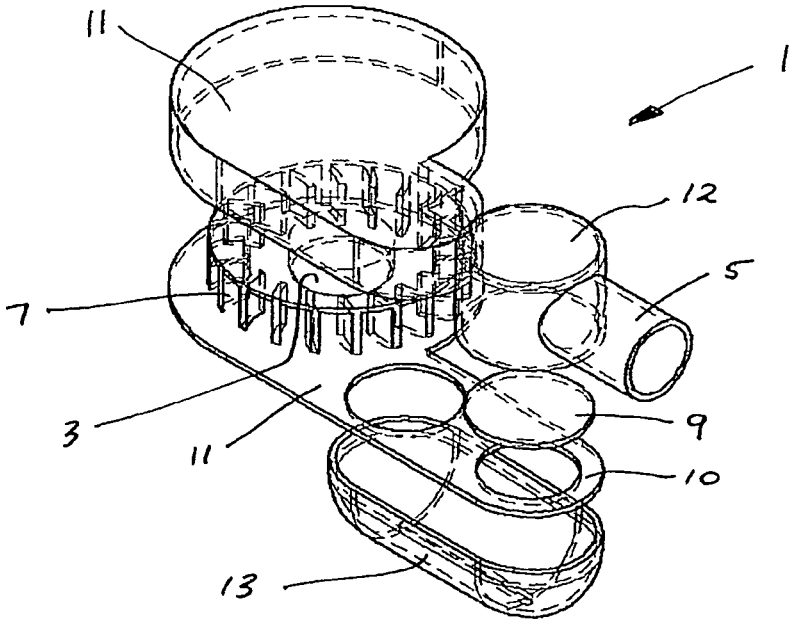
FIG. 2 is an enlarged exploded perspective view of the major components of the extraction device of FIG. 1.

FIGS. 1 to 4 of the drawings show a first embodiment of an odour extraction device 1 for a toilet having a pan 2 and a cistern 4. The extraction device 1 includes an inlet 3 and an outlet 5. The inlet 3 is adapted for gas communication with an interior of the toilet pan 2 above the water level in the pan 2. The outlet 5 is in gas communication with the inlet 3. The outlet 5 is also adapted for gas communication with a sewerage pipe 6.

A suction means, in the form of an impeller fan 7, is provided intermediate the inlet 3 and the outlet 5 for drawing gas from within the pan 2 in through the inlet 3 and out through the outlet 5.

To prevent backflow of unpleasant odours from the sewerage pipe 6 to the pan 2, a one way valve 8 is provided between the inlet 3 and the outlet 5. The valve 8 includes a valve member, in the form of a circular disc 9, and a valve seat 10. The valve member 9 is biased, by gravity, toward a closed position blocking fluid communication between the inlet 3 and the outlet 5 by sealing engagement of the valve member 9 with the valve seat 10. Fluid pressure generated by the impeller fan 7 disengages the valve member 9 from the valve seat 10 to allow the gas to flow therethrough and into the sewerage pipe 6.

A substantially airtight housing 11 is provided intermediate the inlet 3 and the outlet 5. The housing 11 is installed within the cistern 4 and contains the impeller fan 7 and the valve member 9. The housing 11 also includes a cylinder 12 within which the valve member 9 is axially slidably movable. The outlet 5 extends from a side of the cylinder 12. The housing 11 also includes a plenum 13 extending between the impeller fan 7 and the valve seat 10.

An inlet conduit, in the form of overflow pipe 14, fluidly connects the inlet 3 to the toilet pan 2, via the cistern 4. A flexible outlet hose 15 extends from the outlet 5 for fluidly connecting the outlet 5 to the sewerage pipe 6.

The impeller fan 7 is actuated by a 12V electric motor (not shown). This is an advantage as it does not require a qualified Electrician for installation. The motor can also be installed within the cistern 4. The motor can also be battery or solar powered Also, the motor can be continuously operable, actuated by a proximity sensor or manually actuated by a user. The impeller fan 7 is adapted to generate a gas flow rate of about 3.3 L/s.

In use, when the impeller fan 7 is actuated, a negative pressure is created within the cistern 4. This negative pressure draws gas from the toilet pan 2 up through the overflow pipe 14 and into the cistern 4, and from the cistern 4 into the inlet 3 and through the rotational centre of the impeller fan 7. From this point, the pressure generated by the impeller fan 7 pushes the gas through the plenum 13 and forces the valve member 9 upwardly out of engagement with the valve seat 10, whereupon the gas is discharged through the outlet 5 and outlet hose 15 and into the sewerage pipe 6.

As the valve member 9 is gravitationally biased toward the closed position, it automatically moves, due to its own weight, into sealing engagement with the valve seat 10 in the event of power loss to the motor or failure of the impeller fan 7. This provides a failsafe mechanism that ensures that unpleasant odours from the sewerage pipe 6 cannot backflow through the extraction device 1 into the toilet pan 2, even in the event of a loss of power. Further, the absence of mechanical means for biasing the valve member 9 into the closed position, means that the valve 8 is less prone to failure or jamming (e.g. due to wear or oxidation) than the one way valves of known extraction devices. The valve arrangement 8, 9 allows a simple and relatively inexpensive odour extraction device 1 to be produced that is able to exhaust into the sewer, and that can be easily installed in existing or new toilets.

Figure 3:
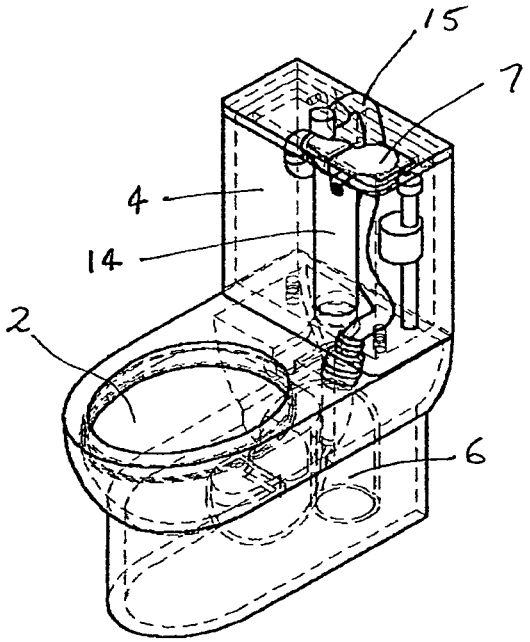
FIG. 3 is a front perspective view of the odour extraction device of FIG. 1, shown installed in a toilet.
Figure 4:
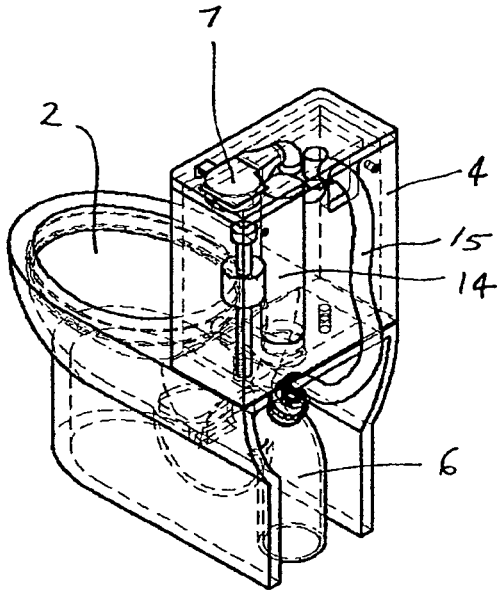
FIG. 4 is a rear perspective view of the odour extraction device of FIG. 1, shown installed in a toilet.
Figure 5:
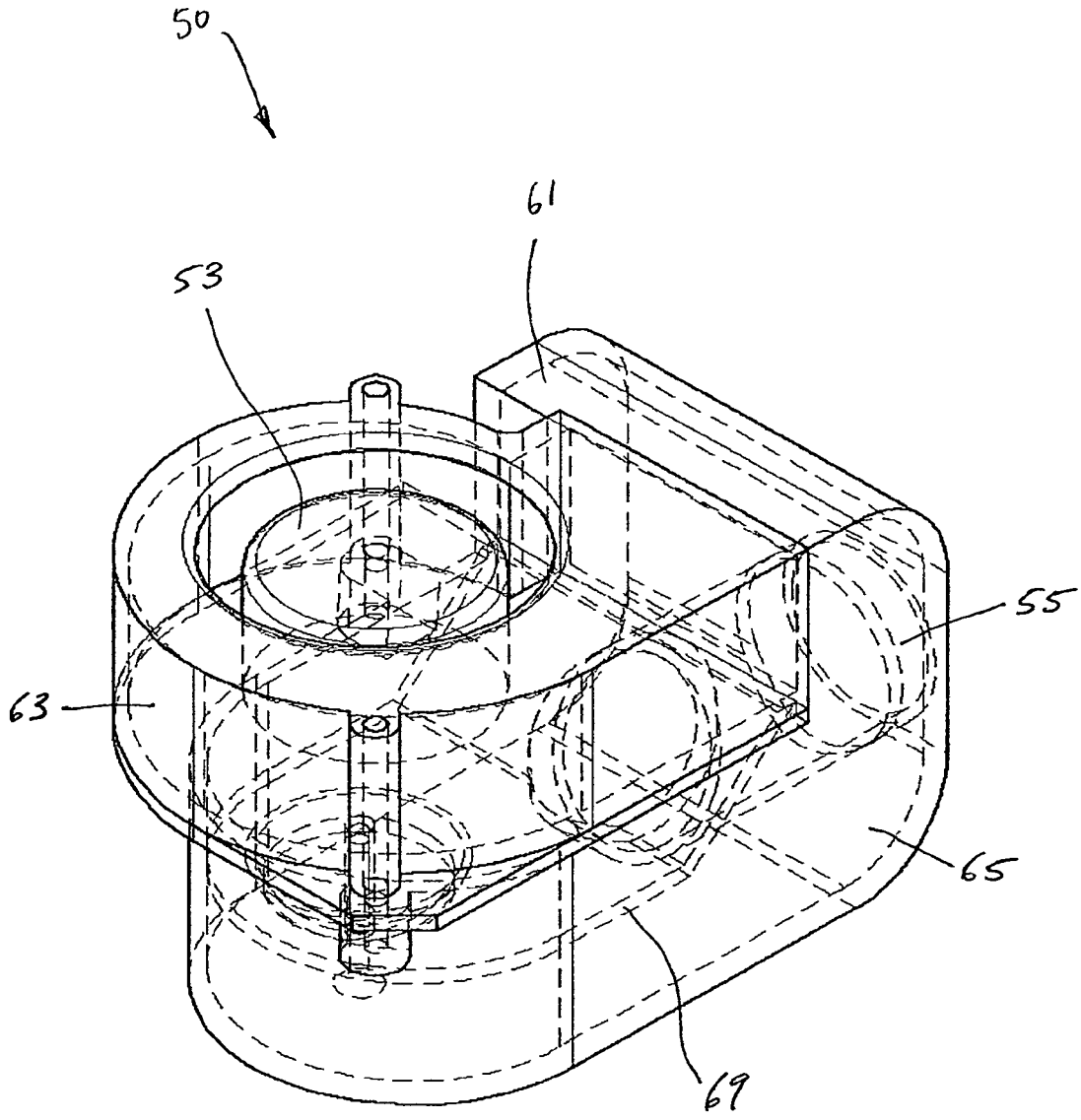
FIG. 5 is a perspective view of a second preferred embodiment of an odour extraction device according to the invention.
Figure 6:
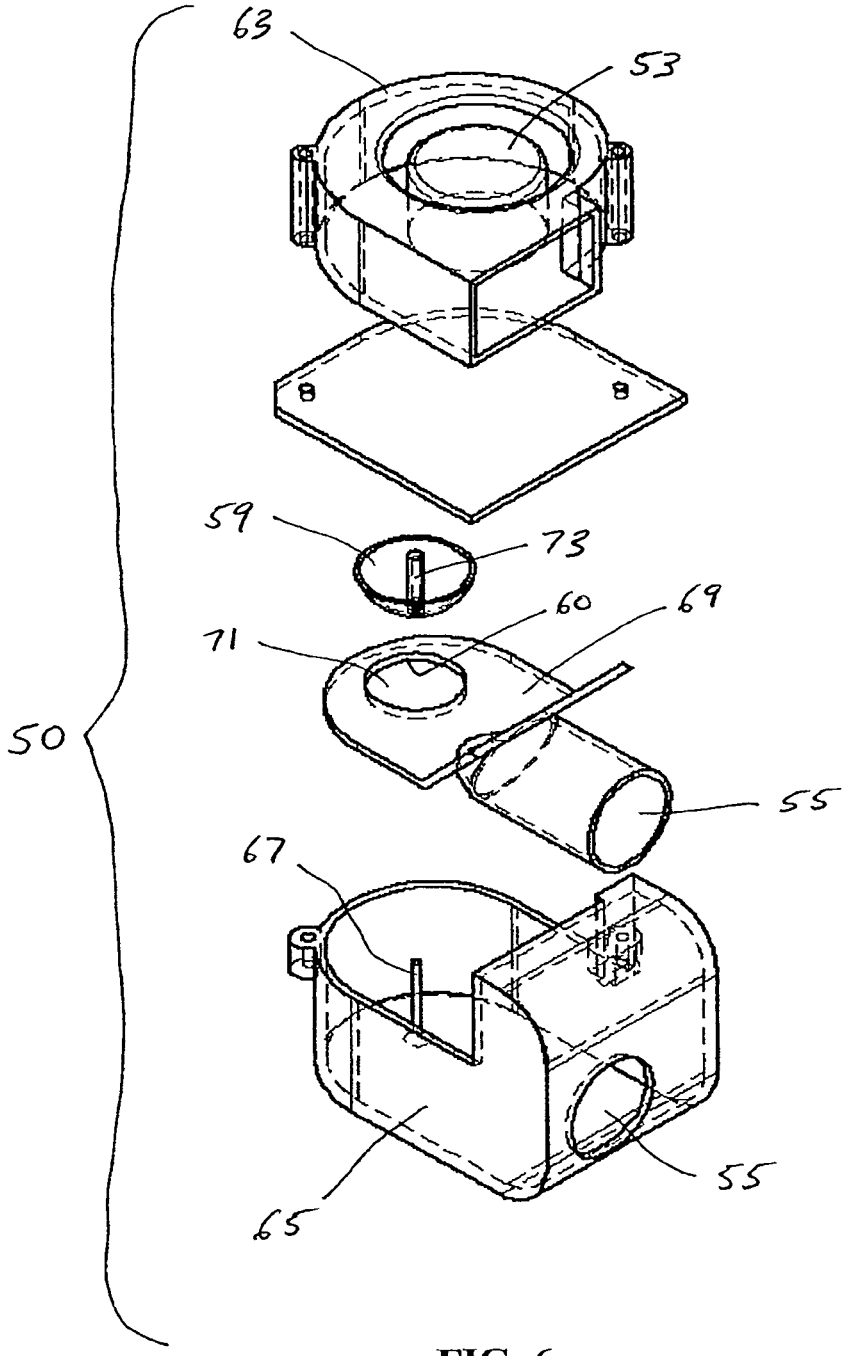
FIG. 6 is an exploded perspective view of the odour extraction device of FIG. 5.

A second embodiment of an odour extraction 50 device for a toilet (as shown in FIGS. 3 and 4), having a pan 2 and a cistern 4, is shown in FIGS. 5 to 8 of the drawings. The extraction device 50 includes an inlet 53 and an outlet 55. The inlet 53 is adapted for gas communication with an interior of the toilet pan 2 above the water level in the pan 2. The outlet 55 is in gas communication with the inlet 53. The outlet 55 is also adapted for gas communication with a sewerage pipe 6.

A suction means, in the form of an impeller fan (not shown), is provided intermediate the inlet 53 and the outlet 55 for drawing gas from within the pan 2 in through the inlet 53 and out through the outlet 55.

To prevent backflow of unpleasant odours from the sewerage pipe 6 to the pan, a one way valve 58 is provided between the inlet 53 and the outlet 55. The valve 58 includes a bowl shaped valve member 59 and a valve seat 60. The valve member 59 is biased, by gravity, toward a closed position blocking fluid communication between the inlet 53 and the outlet 55 by sealing engagement of a convex sealing surface 59A of the valve member 59 with the valve seat 60. Fluid pressure generated by the impeller fan (not shown) disengages the valve member 59 from the valve seat 60 to allow the gas to flow therethrough and into the sewerage pipe 6.

Figure 7:
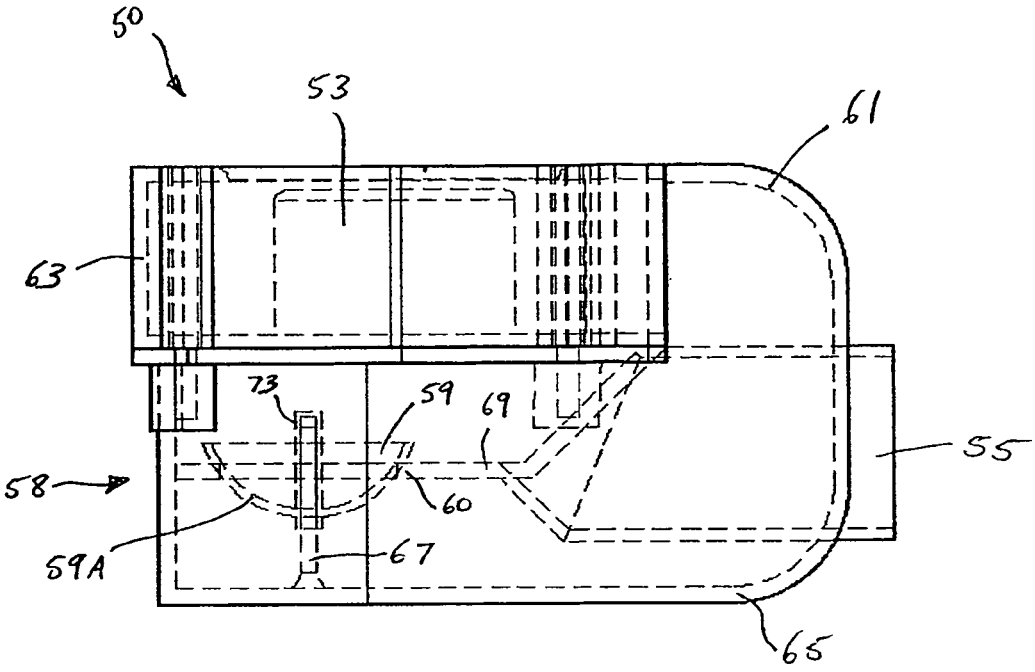
FIG. 7 is a side elevational view of the odour extraction device of FIG. 5, showing the one way valve is a closed position.
Figure 8:
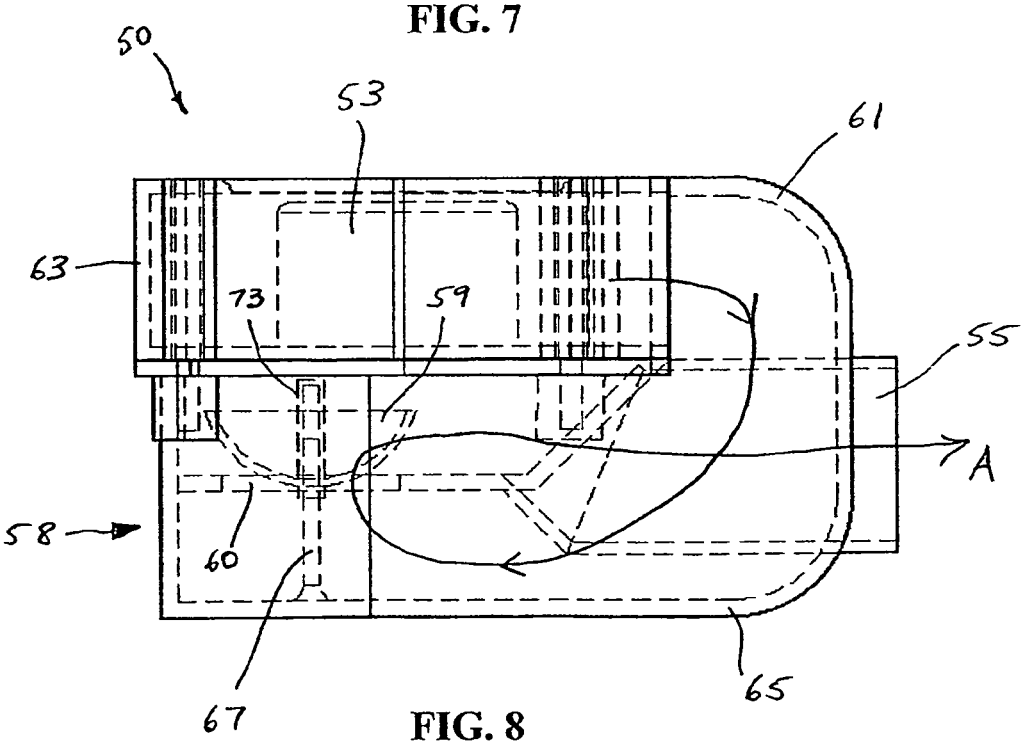
FIG. 8 is a side elevational view of the odour extraction device of FIG. 5, showing the one way valve is an open position.

A substantially airtight housing 61 is provided intermediate the inlet 53 and the outlet 55. The housing 61 is installed within the toilet cistern 4 and contains the impeller fan (not shown) and the valve member 59. The housing 61 includes a sub-casing 63 for containing the impeller fan (not shown) and a plenum 65 extending between the sub-casing 63 and the one way valve 58. The housing 61 also includes a guide post 67 along which the valve member 59 is axially slidable between a closed position, as shown in FIG. 7 and an open position, as shown in FIG. 8.

A divider 69 extends across the housing 61 to divide a section of the housing 61 upstream of the one way valve 58 from a section of the housing 61 downstream of the one way valve 58. The valve seat 60 is defined by the rim of a circular opening 71 in the divider 69. The guide post 67 axially extends through a centre of the circular opening 71. The valve member 59 includes a generally cylindrical guide sleeve 73 slidably engageable around the guide post 67 for guiding the valve member 59 during movement between the open and closed positions.

An inlet conduit, in the form of an overflow pipe 14, fluidly connects the inlet 53 to the toilet pan 2, via the cistern 4. A flexible outlet hose 15 extends from the outlet 55 for fluidly connecting the outlet 55 to the sewerage pipe 6.

The impeller fan (not shown) of the second embodiment has the same characteristics of the impeller fan 7 of the first embodiment.

In use, when the impeller fan (not shown) is actuated, a negative pressure is generated within the cistern 4. This negative pressure draws gas from the toilet pan 2 up through the overflow pipe 14, into the cistern 4, and from the cistern 4, through the inlet opening 53 and through the rotational centre of the impeller fan (not shown). From this point, the pressure generated by the impeller fan (not shown) pushes the gas through the plenum 65 and forces the valve member 59 upwardly along the guide post 67 and out of engagement with the valve seat 60, whereupon the gas is discharged through the outlet 55 and outlet hose (not shown) and into the sewerage pipe (not shown). The direction of airflow through the extraction device 50 is shown by arrow A.

As the valve member 59 is gravitationally biased toward the closed position, it automatically moves, due to its own weight, into sealing engagement with the valve seat 60 in the event of power loss to the motor or failure of the impeller fan (not shown). This provides a failsafe mechanism that ensures that unpleasant odours from the sewerage pipe 6 cannot backflow through the extraction device 50 into the toilet pan 2, even in the event of a loss of power. Further, the absence of mechanical means for biasing the valve member 59 into the closed position, means that the one way valve 58 is less prone to failure or jamming (e.g. due to wear or oxidation) than the one way valves of known extraction devices. The valve arrangement 58, 59 allows a simple and relatively inexpensive odour extraction device 50 to be produced that is able to exhaust into the sewer, and that can be easily installed in existing or new toilets.

Figure 9:
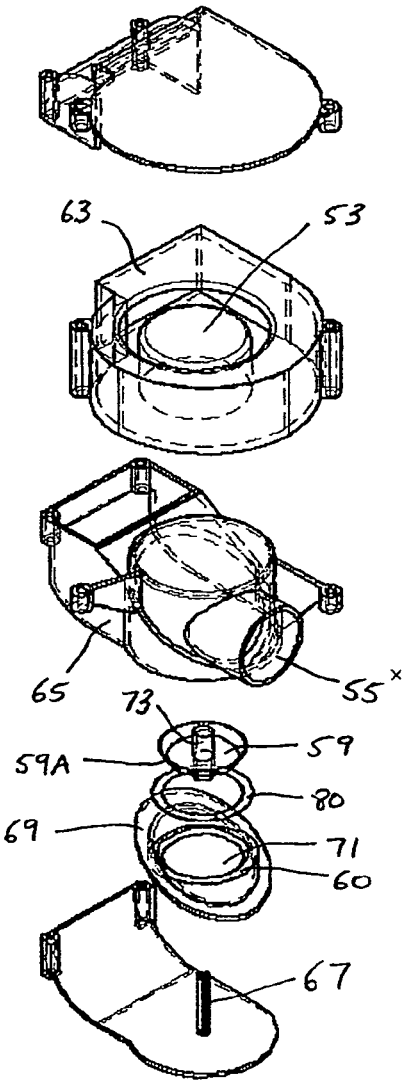
FIG. 9 is an exploded perspective view of a third preferred embodiment of an odour extraction device according to the invention.
Figure 10:
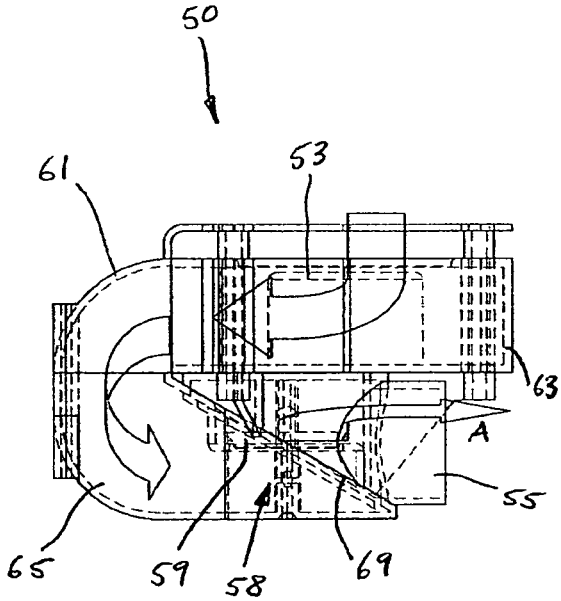
FIG. 10 is a side elevational view of the odour extraction device of FIG. 9, showing the one way valve is a closed position.

A third embodiment of an odour extraction 50 device for a toilet (as shown in FIGS. 3 and 4), having a pan 2 and a cistern 4, is shown in FIGS. 9 and 10 of the drawings. The third embodiment is similar in structure and function to the second embodiment, and like reference numerals are used to indicate corresponding features. However, the third embodiment is of more compact design, and also provides a more streamlined gas flow path through the housing compared to that of the second embodiment. The third embodiment additionally includes an annular sealing member 80 between the valve member 59 and the valve seat 60.

An advantage of the odour extraction device 1, 50 is that the valve 8, 58 can act as an air admittance valve (AAV), to allow air into the sewerage pipe 6 when negative pressure is generated upstream of the valve 8, 58 during flushing of the toilet to prevent siphonage. This advantage of the odour extraction device 1, 50 can negate the requirement for external sewerage pipe venting stacks, which are difficult and expensive to install. Also, unlike conventional AAVs, the odour extraction device 1, 50 is provided in the toilet cistern, thereby facilitating the toilet's use in confined spaces and alleviating the requirement for the special housing required by many known AAVs.

Although the invention has been described with the reference to the preferred embodiments, it will be appreciated by those persons skilled in the art that the invention may be embodied in many other forms.

The invention claimed is:

1. An odor extraction device for a toilet pan, said odor extraction device comprising:

an inlet configured for gas communication with an interior of the toilet pan above a water level in the pan;

an outlet in gas communication with the inlet and configured for gas communication with a sewerage pipe;

a suction apparatus intermediate the inlet and the outlet, configured to draw gas from within the pan in through the inlet and out through the outlet;

a one way valve between the inlet and the outlet, the valve comprising a valve member and a valve seat, the valve member being biased, by gravity, toward a closed position blocking fluid communication between the inlet and the outlet by sealing engagement of the valve member with the valve seat, wherein fluid pressure generated by the suction apparatus disengages the valve member from the valve seat to allow the gas to flow through the valve; and a substantially airtight housing intermediate the inlet and the outlet, the housing containing the suction apparatus and the valve member, wherein the housing includes a guide post along which the valve member is axially slidable between an open position and the closed position.

2. An odor extraction device according to claim 1, wherein the suction apparatus comprises an impeller fan.

3. An odor extraction device according to claim 2, wherein gases from the inlet are drawn through a rotational center of the impeller fan.

4. An odor extraction device according to claim 1, wherein the valve member is a substantially circular disc.

5. An odor extraction device according to claim 1, wherein the housing comprises a cylinder within which the valve member is axially slidably movable.

6. An odor extraction device according to claim 5, wherein the outlet extends from a side of said cylinder.

7. An odor extraction device according to claim 1, further comprising a plenum extending between the suction apparatus and the valve seat.

8. An odor extraction device according to claim 1, further comprising a divider extending across the housing to divide a section of the housing upstream of the one way valve from a section of the housing downstream of the one way valve.

9. An odor extraction device according to claim 8, wherein the valve seat is defined by a rim of a substantially circular opening in the divider.

10. An odor extraction device according to claim 9, wherein the guide post axially extends substantially through a center of the circular opening.

11. An odor extraction device according to claim 1, wherein the valve member is bowl shaped and has a convex sealing surface engageable with the valve seat.

12. An odor extraction device according to claim 1, wherein the valve member comprises a generally cylindrical guide sleeve slidably engageable around the guide post for guiding the valve member during movement between the open and closed positions.

13. An odor extraction device according to claim 1, wherein the housing comprises a sub-casing for containing the suction apparatus.

14. An odor extraction device according to claim 13, further comprising a plenum extending between the sub-casing and the one way valve.

15. An odor extraction device according to claim 1, wherein the housing is configured for installation in a toilet cistern.

16. An odor extraction device according to claim 15, wherein the inlet is defined by an opening in the housing, through which the suction apparatus draws gas from within the cistern.

17. An odor extraction device according to claim 16, wherein the action of the suction apparatus creates a negative pressure within the cistern to draw gas from the toilet pan through an overflow pipe of the toilet, into the cistern, through the opening in the housing, through the housing and out through the outlet for discharge into the sewerage pipe.

18. An odor extraction device according to claim 1, further comprising an electric motor for actuating the suction apparatus.

19. An odor extraction device according to claim 18, wherein the electric motor is a 12V DC electric motor.

20. An odor extraction device according to claim 1, further comprising an inlet conduit extending from the inlet for fluidly connecting the inlet to the toilet pan.

21. An odor extraction device according to claim 20, wherein the inlet conduit is flexible.

22. An odor extraction device according to claim 1, further comprising an outlet conduit extending from the outlet for fluidly connecting the outlet to the sewerage pipe.

23. An odor extraction device according to claim 22, wherein the outlet conduit is flexible.

24. An odor extraction device according to claim 1, wherein the suction apparatus is configured to generate a gas flow rate of greater than around 2 L/s.

25. An odor extraction device according to claim 24, wherein the suction apparatus is configured to generate a gas flow rate of greater than around 3 L/s.

26. An odor extraction device according to claim 25, wherein the suction apparatus is configured to generate a gas flow rate of above about 3.3 L/s.

27. A one way valve for a toilet odor extraction device, the valve comprising:

an inlet;

an outlet;

a substantially airtight housing intermediate the inlet and the outlet, the housing comprising a guide post;

a valve seat; and a valve member contained in the housing, wherein the valve member is biased, by gravity, towards a closed position blocking gas communication between the inlet and the outlet by sealing engagement of the valve member with the valve seat, wherein the valve member is configured to disengage from the valve seat to allow gas to flow through the valve in response to the generation of a pressure differential across the valve member, and wherein the valve member is axially slidable along the guide post between an open position and the closed position.

28. A one way valve according to claim 27, wherein the housing comprises a cylinder within which the valve member is axially slidably movable.

29. A one way valve according to claim 28, wherein the outlet extends from a side of said cylinder.

30. A one way valve according to claim 27, wherein the valve member is a substantially circular disc.

31. A one way valve according to claim 27, further comprising a divider extending across the housing to divide a section of the housing upstream of the one way valve from a section of the housing downstream of the one way valve.

32. A one way valve according to claim 31, wherein the valve seat is defined by a rim of a substantially circular opening in the divider.

33. A one way valve according to claim 32, wherein the guide post axially extends substantially through a center of the circular opening.

34. A one way valve according to claim 27, wherein the valve member is bowl shaped and has a convex sealing surface engageable with the valve seat.

35. A one way valve according to claim 27, wherein the valve member comprises a generally cylindrical guide sleeve slidably engageable around the guide post for guiding the valve member during movement between the open and closed positions.

* * * * *